US009523139B2

(12) United States Patent
Haga et al.

(10) Patent No.: US 9,523,139 B2
(45) Date of Patent: Dec. 20, 2016

(54) COLD-ROLLED STEEL SHEET

(75) Inventors: Jun Haga, Nishinomiya (JP); Takuya Nishio, Nishinomiya (JP); Masayuki Wakita, Nishinomiya (JP); Yasuaki Tanaka, Nishinomiya (JP); Norio Imai, Nishinomiya (JP); Toshiro Tomida, Kobe (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 432 days.

(21) Appl. No.: 14/130,552

(22) PCT Filed: Jun. 27, 2012

(86) PCT No.: PCT/JP2012/066380
§ 371 (c)(1),
(2), (4) Date: Apr. 3, 2014

(87) PCT Pub. No.: WO2013/005618
PCT Pub. Date: Jan. 10, 2013

(65) Prior Publication Data

US 2014/0241933 A1 Aug. 28, 2014

(30) Foreign Application Priority Data

Jul. 6, 2011 (JP) ..... 2011-150239
Jul. 6, 2011 (JP) ..... 2011-150240
Jul. 6, 2011 (JP) ..... 2011-150245

(51) Int. Cl.
*C22C 38/02* (2006.01)
*C22C 38/04* (2006.01)
(Continued)

(52) U.S. Cl.
CPC ..... *C22C 38/38* (2013.01); *C21D 1/673* (2013.01); *C21D 9/48* (2013.01); *C22C 38/001* (2013.01);
(Continued)

(58) Field of Classification Search
CPC .... C22C 38/001; C22C 38/002; C22C 38/005; C22C 38/02; C22C 38/04; C22C 38/06; C22C 38/12; C22C 38/14; C22C 38/26; C22C 38/38; C21D 2211/001; C21D 2211/002; C21D 2211/005; C21D 2211/008
(Continued)

(56) References Cited

U.S. PATENT DOCUMENTS 6,221,179 B1 * 4/2001 Yasuhara ..... C21D 8/0226 148/333
6,319,338 B1 * 11/2001 Kawano ..... C21D 8/02 148/320
(Continued)

FOREIGN PATENT DOCUMENTS

EP 1 362 930 11/2003
EP 1 512 760 3/2005
(Continued)

OTHER PUBLICATIONS

English translation of the Written Opinion of the International Search Report mailed Oct. 2012 for PCT/JP2012/066380; 5 pages.*
(Continued)

*Primary Examiner* — Helene Klemanski
(74) *Attorney, Agent, or Firm* — Clark & Brody

(57) ABSTRACT

A high-strength cold-rolled steel sheet excellent in ductility, work hardenability, and stretch flangeability, and having tensile strength of 780 MPa or more includes: a chemical composition containing, in mass percent, C: more than 0.020% to less than 0.30%, Si: more than 0.10% to 3.00% or less, Mn: more than 1.00% to 3.50% or less; and metallurgical structure whose main phase is a low-temperature transformation product, and whose secondary phase contains retained austenite. The retained austenite has a volume fraction relative to overall structure of more than
(Continued)

4.0% to less than 25.0% and an average grain size of less than 0.80 μm, and of the retained austenite, the number density of retained austenite grains whose grain size is 1.2 μm or more is $3.0\times10^{-2}$ grains/$\mu m^2$ or less.

6 Claims, 2 Drawing Sheets

(51) Int. Cl.

| | |
|---|---|
| ***C22C 38/06*** | (2006.01) |
| ***C22C 38/12*** | (2006.01) |
| ***C22C 38/14*** | (2006.01) |
| ***C22C 38/26*** | (2006.01) |
| ***C22C 38/38*** | (2006.01) |
| ***C22C 38/00*** | (2006.01) |
| ***C21D 9/48*** | (2006.01) |
| ***C21D 1/673*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/26* (2013.01); *C21D 2211/001* (2013.01); *C21D 2211/002* (2013.01); *C21D 2211/005* (2013.01); *C21D 2211/008* (2013.01)

(58) Field of Classification Search
USPC ... 420/83, 84, 103, 104, 106, 117, 118, 120, 420/123, 126, 127, 128; 148/330, 331, 148/333, 334, 337
See application file for complete search history.

(56) References Cited

U.S. PATENT DOCUMENTS

2004/0069382 A1* 4/2004 Yokoi ..... C22C 38/002 148/650
2005/0081966 A1* 4/2005 Kashima ..... C22C 38/02 148/651
2006/0130937 A1* 6/2006 Ikeda ..... C22C 38/02 148/320
2008/0023112 A1* 1/2008 Kashima ..... B32B 15/012 148/320
2008/0202639 A1* 8/2008 Tomida ..... C22C 38/04 148/333
2010/0003541 A1* 1/2010 Futamura ..... C21D 8/02 428/659
2014/0212686 A1* 7/2014 Imai ..... C22C 38/02 428/659
2014/0238557 A1* 8/2014 Haga ..... C22C 38/001 148/603

FOREIGN PATENT DOCUMENTS

| | | |
|---|---|---|
| JP | 58-123823 | 7/1983 |
| JP | 59-229413 | 12/1984 |
| JP | 11-061326 | 3/1999 |
| JP | 11-152544 | 6/1999 |
| JP | 2001-192768 | 7/2001 |
| JP | 2003-277884 | 10/2003 |
| JP | 2004-190050 | 7/2004 |
| JP | 2005-179703 | 7/2005 |
| JP | 2005-336526 | 12/2005 |
| JP | 2006-336074 | 12/2006 |
| JP | 2007-182625 | 7/2007 |
| JP | 2010/065272 A * | 3/2010 |
| JP | 2011/140686 A * | 7/2011 |
| WO | 2007/015541 | 2/2007 |

OTHER PUBLICATIONS

English translation of JP 2011/140686; Jul. 2011; 24 pages.*
English translation of JP 2010/065272; Mar. 2010; 22 pages.*
English translation of JP 2005/336526; Dec. 2005; 25 pages.*
English translation of JP 2006/336074; Dec. 2006; 20 pages.*

* cited by examiner

COLD-ROLLED STEEL SHEET

TECHNICAL FIELD

The invention relates to a cold-rolled steel sheet. More particularly, it relates to a high-strength cold-rolled steel sheet that is excellent in ductility, work hardenability, and stretch flangeability.

BACKGROUND ART

In these days when the industrial technology field is highly fractionalized, a material used in each technology field has been required to deliver special and high performance. For example, for a cold-rolled steel sheet that is press-formed and put in use, more excellent formability has been required with the diversification of press shapes. In addition, as a high strength has been required, the use of a high-strength cold-rolled steel sheet has been studied. In particular, concerning an automotive steel sheet, in order to reduce the vehicle body weight and thereby to improve the fuel economy from the perspective of global environments, a demand for a thin high-strength cold-rolled steel sheet having high formability has been increasing remarkably. In press forming, as the thickness of steel sheet used is smaller, cracks and wrinkles are liable to occur. Therefore, a steel sheet further excellent in ductility and stretch flangeability is required. However, the press formability and the high strengthening of steel sheet are characteristics contrary to each other, and therefore it is difficult to satisfy these characteristics at the same time.

So far, as a method for improving the press formability of a high-strength cold-rolled steel sheet, many techniques concerning grain refinement of micro-structure have been proposed. For example, Patent Document 1 discloses a method for producing a very fine grain high-strength hot-rolled steel sheet that is subjected to rolling at a total draft of 80% or higher in a temperature region in the vicinity of $Ar_3$ point in the hot-rolling process. Patent Document 2 discloses a method for producing an ultrafine ferritic steel that is subjected to continuous rolling at a draft of 40% or higher in the hot-rolling process.

By these techniques, the balance between strength and ductility in hot-rolled steel sheet is improved. However, the above-described Patent Documents do not at all describe a method for making a fine-grain cold-rolled steel sheet to improve the press formability. According to the study conducted by the present inventors, if cold rolling and annealing are performed on the fine-grain hot-rolled steel sheet obtained by high reduction rolling, the crystal grains are liable to be coarsened, and it is difficult to obtain a cold-rolled steel sheet excellent in press formability. In particular, in the manufacturing of a complex phase cold-rolled steel sheet containing a low-temperature transformation product or retained austenite in the structure, which must be annealed in the high-temperature region of $Ac_1$ point or higher, the coarsening of crystal grains at the time of annealing is remarkable, and the advantage of complex phase cold-rolled steel sheet that the ductility is excellent cannot be enjoyed.

Patent Document 3 discloses a method for producing a hot-rolled steel sheet having ultrafine grains, in which method, rolling in the dynamic recrystallization region is performed with a rolling pass of five or more stands. However, the lowering of temperature at the hot-rolling must be decreased extremely, and it is difficult to carry out this method in a general hot-rolling equipment. Also, although Patent Document 3 describes an example in which cold rolling and annealing are performed after hot rolling, the balance between tensile strength and hole expansibility (stretch flangeability) is poor, and the press formability is insufficient.

Concerning the cold-rolled steel sheet having a fine structure, Patent Document 4 discloses an automotive high-strength cold-rolled steel sheet excellent in crashworthiness and formability, in which retained austenite having an average crystal grain size of 5 μm or smaller is dispersed in ferrite having an average crystal grain size of 10 μm or smaller. The steel sheet containing retained austenite in the structure exhibits a large elongation due to transformation induced plasticity (TRIP) produced by the transformation from austenite to martensite during working; however, the hole expansibility is impaired by the formation of hard martensite. For the cold-rolled steel sheet disclosed in Patent Document 4, it is supposed that the ductility and hole expansibility are improved by making ferrite and retained austenite fine. However, the limiting hole expansion ratio is at most 1.5, and it is difficult to say that sufficient press formability is provided. Also, to enhance the work hardening coefficient and to improve the crashworthiness, it is necessary to make the main phase a soft ferrite, and it is difficult to obtain a high-strength strength.

Patent Document 5 discloses a high-strength steel sheet excellent in elongation and stretch flangeability, in which the secondary phase consisting of retained austenite and/or martensite is dispersed finely within the crystal grains. However, to make the secondary phase fine to a nano size and to disperse it within the crystal grains, it is necessary to contain expensive elements such as Cu and Ni in large amounts and to perform solution treatment at a high temperature for a long period of time, so that the rise in production cost and the decrease in productivity are remarkable.

Patent Document 6 discloses a high-strength hot dip galvanized steel sheet excellent in ductility, stretch flangeability, and fatigue resistance property, in which retained austenite and low-temperature transformation product are dispersed in ferrite and tempered martensite having an average crystal grain size of 10 μm or smaller. The tempered martensite is a phase that is effective in improving the stretch flangeability and fatigue resistance property, and it is supposed that if grain refinement of tempered martensite is performed, these properties are further improved. However, in order to obtain a metallurgical structure containing tempered martensite and retained austenite, primary annealing for forming martensite and secondary annealing for tempering martensite and further for obtaining retained austenite are necessary, so that the productivity is impaired significantly.

Patent Document 7 discloses a method for producing a cold-rolled steel sheet in which retained austenite is dispersed in fine ferrite, in which method, the steel sheet is cooled rapidly to a temperature of 720° C. or lower immediately after being hot-rolled, and is held in a temperature range of 600 to 720° C. for 2 seconds or longer, and the obtained hot-rolled steel sheet is subjected to cold rolling and annealing.

CITATION LIST

Patent Document

Patent Document 1: JP 58-123823 A1
Patent Document 2: JP 59-229413 A1

Patent Document 3: JP 11-152544 A1
Patent Document 4: JP 11-61326 A1
Patent Document 5: JP 2005-179703 A1
Patent Document 6: JP 2001-192768 A1
Patent Document 7: WO2007/15541 A1

SUMMARY OF INVENTION

The above-described technique disclosed in Patent Document 7 is excellent in that a cold-rolled steel sheet in which a fine grain structure is formed and the workability and thermal stability are improved can be obtained by a process in which after hot rolling has been finished, the work strain accumulated in austenite is not released, and ferrite transformation is accomplished with the work strain being used as a driving force.

However, due to needs for higher performance in recent years, a cold-rolled steel sheet provided with a high strength, good ductility, excellent work hardenability, and excellent stretch flangeability at the same time has come to be demanded.

The invention has been made to meet such a demand. Specifically, an objective of the invention is to provide a high-strength cold-rolled steel sheet having excellent ductility, work hardenability, and stretch flangeability, in which the tensile strength is 780 MPa or higher.

The present inventors conducted detailed examinations of the influence of chemical composition and manufacturing conditions exerted on the mechanical properties of a high-strength cold-rolled steel sheet. In this description, symbol "%" indicating the content of each element in the chemical composition of steel means mass percent.

A series of sample steels had a chemical composition consisting, in mass percent, of C: more than 0.020% and less than 0.30%, Si: more than 0.10% and 3.00% or less, Mn: more than 1.00% and 3.50% or less, P: 0.10% or less, S: 0.010% or less, sol.Al: 2.00% or less, and N: 0.010% or less.

A slab having the above-described chemical composition was heated to 1200° C., and thereafter was hot-rolled so as to have a thickness of 2.0 mm in various rolling reduction patterns in the temperature range of $Ar_3$ point or higher. After being hot-rolled, the steel sheets were cooled to the temperature region of 720° C. or lower under various cooling conditions. After being air-cooled for 5 to 10 seconds, the steel sheets were cooled to various temperatures at a cooling rate of 90° C./s or lower. This cooling temperature was used as the coiling temperature. After the steel sheets had been charged into an electric heating furnace held at the same temperature and had been held for 30 minutes, the steel sheets were furnace-cooled at a cooling rate of 20° C./h, whereby the gradual cooling after coiling was simulated. The hot-rolled steel sheets thus obtained were subjected to pickling and cold-rolled at a draft of 50% so as to have a thickness of 1.0 mm. Using a continuous annealing simulator, the obtained cold-rolled steel sheets were heated to various temperatures and held for 95 seconds, and thereafter cooled to obtain annealed steel sheets.

From each of hot-rolled steel sheets and annealed steel sheets, a test specimen for micro structure observation was sampled. By using a optical microscope and scanning electron microscope (SEM) equipped an electron backscatter diffraction pattern (EBSP) analyzer, the structure was observed at a position deep by one-fourth of thickness from the surface of steel sheet, and by using an X-ray diffractometry (XRD) apparatus, the volume fraction of retained austenite was measured at a position deep by one-fourth of thickness from the surface of annealed steel sheet. Also, from the annealed steel sheet, a tensile test specimen was sampled along the direction perpendicular to the rolling direction. By using this tensile test specimen, a tensile test was conducted, whereby the ductility was evaluated by total elongation, and the work hardenability was evaluated by the work hardening coefficient (n-value) in the strain range of 5 to 10%. Further, from the annealed steel sheet, a 100-mm square hole expanding test specimen was sampled. By using this test specimen, a hole expanding on test was conducted, whereby the stretch flangeability was evaluated. In the hole expanding test, a 10-mm diameter punched hole was formed with a clearance being 12.5%, the punched hole was expanded by using a cone-shaped punch having a front top angle of 60°, and the expansion ratio (limiting hole expansion ratio) of the hole at the time when a crack penetrating the sheet thickness was generated was measured.

As the result of these preliminary tests, the findings described in the following items (A) to (H) were obtained.

(A) If the hot-rolled steel sheet, which is produced through a so-called immediate rapid cooling process where rapid cooling is performed by water cooling immediately after hot rolling, specifically, the hot-rolled steel sheet is produced in such a way that the steel is rapidly cooled to the temperature region of 720° C. or lower within 0.40 second after the completion of hot rolling, is cold-rolled and annealed, the ductility and stretch flangeability of annealed steel sheet are improved with the rise in annealing temperature. However, if the annealing temperature is too high, the austenite grains are coarsened, and the ductility and stretch flangeability of annealed steel sheet may be deteriorated abruptly.

(B) Increase in final rolling reduction in the hot rolling restrains coarsening of austenite grains that may occur during the annealing at a high temperature after the cold rolling. The reason for this is not clear, but this is assumed to result from the fact that: (a) as the final rolling reduction becomes more increased, ferrite fraction in the structure of the hot-rolled steel sheet becomes more increased, and refinement of ferrite becomes more encouraged as well; (b) as the final rolling reduction becomes more increased, a coarse low-temperature transformation product in the structure of the hot-rolled steel sheet becomes more decreased; (c) ferrite grain boundaries function as nucleation sites in transformation from ferrite to austenite during the annealing, and thus as there exist more refined ferrite grains, a nucleation rte become more increased, so that austenite becomes more refined; and (d) a coarse low-temperature transformation product becomes coarse austenite grains during the annealing.

(C) If the coiling temperature is increased in a coiling process after rapid cooling immediately after rolling, coarsening of austenite grains that may occur during the annealing at a high temperature after the cold rolling is restrained. The reason for this is not clear, but this is assumed to result from the fact that: (a) the hot-rolled steel sheet is refined due to the rapid cooling immediately after rolling, and thus increase in coiling temperature significantly increases the amount of precipitation of iron carbide in the hot-rolled steel sheet; (b) the iron carbide functions as a nucleation site in transformation from ferrite to austenite during the annealing, and thus as the amount of precipitation of iron carbide becomes more increased, the nucleation rate becomes more increased, thereby to refine austenite; and (c) undissolved iron carbide suppresses growth of austenite grains, which results in refinement of austenite.

(D) As the Si content becomes greater in the steel, an effect of preventing coarsening of austenite grains becomes stronger. The reason for this is not clear, but this is assumed to result from the fact that: (a) increase in the Si content causes refinement of iron carbide, which increases its number density; (b) hence, the nucleation rate in transformation from ferrite to austenite becomes further increased; and (c) increase in undissolved iron carbide further suppresses growth of austenite grains, which encourages further refinement of austenite.

(E) By soaking the steel at a high temperature while restraining coarsening of austenite grains and then cooling it, it is possible to obtain metallurgical structure whose main phase is a refined low-temperature transformation product, and whose secondary phase contains refined retained austenite, and also contains refined polygonal ferrite in some cases.

FIG. 1 is a graph showing the result of examination of grain size distribution of retained austenite in an annealed steel sheet obtained by hot-rolling under the conditions of the final rolling reduction of 42% in thickness decrease percentage, the finish rolling temperature of 900° C., the rapid cooling stop temperature of 660° C., and the time of 0.16 seconds from rolling completion to rapid cooling stop, and the coiling temperature of 520° C., followed by annealing at a soaking temperature of 850° C. FIG. 2 is a graph showing the result of examination of grain size distribution of retained austenite in an annealed steel sheet obtained by hot-rolling a slab having the same chemical composition by using an ordinary method without the immediate rapid cooling process, and by cold rolling and annealing the hot-rolled steel sheet. From the comparison of FIG. 1 and FIG. 2, it can be seen that, for the annealed steel sheet produced through a proper immediate rapid cooling process (FIG. 1), the formation of coarse austenite grains having the grain size of 1.2 μm or larger is restrained, and retained austenite is dispersed finely.

(F) Suppression of generation of coarse retained austenite grains whose grain size is 1.2 μm or more enhances the stretch flangeability of the steel sheet whose main phase is a low-temperature transformation product.

FIG. 3 is a graph showing a relation between $TS^{1.7}\times\lambda$ and the number density ($N_R$) of coarse retained austenite whose grain size is 1.2 μm or more. TS denotes a tensile strength, λ denotes a limiting hole expansion ratio, and $TS^{1.7}\times\lambda$ denotes an coefficient for evaluating the hole expansiblity based on the balance between the strength and the limiting hole expansion ratio. As shown in this drawing, it is understood that $TS^{1.7}\times\lambda$ and $N_R$ has a correlation, and as $N_R$ becomes smaller, the hole expansibility becomes more enhanced. The reason for this is not clear, but this is assumed to result from the fact that: (a) retained austenite is changed into hard martensite through working, and if the retained austenite grains are coarse, the martensite grains also become coarse, and stress concentration becomes increased, which easily causes void at an interface with a matrix phase, resulting in initiation of cracking; and (b) coarse retained austenite grains become martensite at an early stage of working, and thus they more easily become initiation of cracking than refined retained austenite grains do.

(G) As the annealing temperature becomes more increased, the fraction of the low-temperature transformation product becomes more increased, so that work hardenability tends to be deteriorated; however, it is possible to prevent deterioration of the work hardenability in the steel sheet whose main phase is the low-temperature transformation product by suppressing generation of coarse retained austenite grains having a grain size of 1.2 μm or more.

FIG. 4 is a graph showing a relation between a TS×n-value and $N_R$. The TS×n-value is an coefficient for evaluating the work hardenability based on the balance between the strength and the work hardening coefficient. As shown in this drawing, it is understood that the TS×n-value has a correlation with $N_R$, and as $N_R$ becomes smaller, the work hardenability becomes more enhanced. The reason for this is not clear, but it is assumed to result from the fact that: (a) coarse retained austenite grains become martensite at an early stage of working where strain is less than 5%, and thus they hardly contribute to increase in the n-value within the strain range of 5 to 10%; and (b) by suppressing generation of coarse retained austenite grains, refined retained austenite grains that become martensite in a high strain range of 5% or more become increased.

(H) As grains having a bcc (body-centered cubic) structure and grains having a bct (body-centered tetragonal) structure (two kinds of these grains are also collectively referred to as "bcc grains", hereinafter), which are surrounded by grain boundaries whose misorientation angle is 15° or more, have smaller average grain sizes, ductility, work hardenability, and stretch flangeability of the steel sheet having metallurgical structure whose main phase is the low-temperature transformation product, and whose secondary phase contains retained austenite are enhanced. The reason for this is not clear, but this is assumed to result from the fact that: (a) the arrangement of retained austenite becomes more preferable due to the refinement of the bcc grains; and (b) crack propagation is suppressed by the refinement of the bcc grains.

Based on the above results, it has been found that steel containing certain amount or more of Si is hot-rolled with greater final rolling reduction, and thereafter is subjected to rapid cooling immediately after rolling, the steel is coiled state at a high temperature, and is subjected to cold rolling, and then is annealed at a high temperature, and thereafter is cooled, thereby to produce a cold-rolled steel sheet excellent in ductility, work hardenability, and stretch flangeability, and including metallurgical structure whose main phase is a low-temperature transformation product, and whose secondary phase contains retained austenite and preferably further contains polygonal ferrite, wherein the metallurgical structure contains fewer coarse austenite grains whose grain size is 1.2 μm or more, and preferably contains refined bcc grains.

The present invention provides a cold-rolled steel sheet including a chemical composition consisting, in mass percent, of C: more than 0.020% to less than 0.30%; Si: more than 0.10% to 3.00% or less; Mn: more than 1.00% to 3.50% or less; P: 0.10% or less; S: 0.010% or less; sol.Al: 0% or more to 2.00% or less; N: 0.010% or less; Ti: 0% or more to less than 0.050%; Nb: 0% or more to less than 0.050%; V: 0% or more to 0.50% or less; Cr: 0% or more to 1.0% or less; Mo: 0% or more to 0.50% or less; B: 0% or more to 0.010% or less; Ca: 0% or more to 0.010% or less; Mg: 0% or more to 0.010% or less; REM: 0% or more to 0.050% or less; Bi: 0% or more to 0.050% or less; and the remainder being Fe and impurities, wherein the cold-rolled steel sheet includes metallurgical structure whose main phase is a low-temperature transformation product, and whose secondary phase contains retained austenite; the retained austenite has a volume fraction of more than 4.0% to less than 25.0% relative to overall structure, and an average grain size of less than 0.80 μm; and of the retained austenite, a number density of retained austenite grains whose grain size is 1.2 μm or more is $3.0\times10^{-2}$ grains/$\mu m^2$ or less.

The metallurgical structure of the cold-rolled steel sheet according to the present invention preferably satisfies one or both of the followings:

the average grain size of grains having bcc structure and grains having bct structure that are surrounded by grain boundaries whose misorientation angle is 15° or more is 7.0 μm or less; and the secondary phase contains retained austenite and polygonal ferrite, and the polygonal ferrite has a volume fraction of more than 2.0% to less than 27.0% relative to overall structure, and an average grain size of less than 5.0 μm.

In the preferred mode, the chemical composition further contains at least one kind of the elements (% means mass percent) described below.

One kind or two or more kinds selected from a group consisting of Ti: 0.005% or more and less than 0.050%, Nb: 0.005% or more and less than 0.050%, and V: 0.010% or more and 0.50% or less; and/or One kind or two or more kinds selected from a group consisting of Cr: 0.20% or more and 1.0% or less, Mo: 0.05% or more and 0.50% or less, and B: 0.0010% or more and 0.010% or less; and/or One kind or two or more kinds selected from a group consisting of Ca: 0.0005% or more and 0.010% or less, Mg: 0.0005% or more and 0.010% or less, REM: 0.0005% or more and 0.050% or less, and Bi: 0.0010% or more and 0.050% or less.

According to the present invention, a high-strength cold-rolled steel sheet having sufficient ductility, work hardenability, and stretch flangeability, which can be used for working such as press forming, can be obtained. Therefore, the present invention can greatly contribute to the development of industry. For example, the present invention can contribute to the solution to global environment problems through the weight reduction of automotive vehicle body.

DESCRIPTION OF EMBODIMENTS

Figure 1:
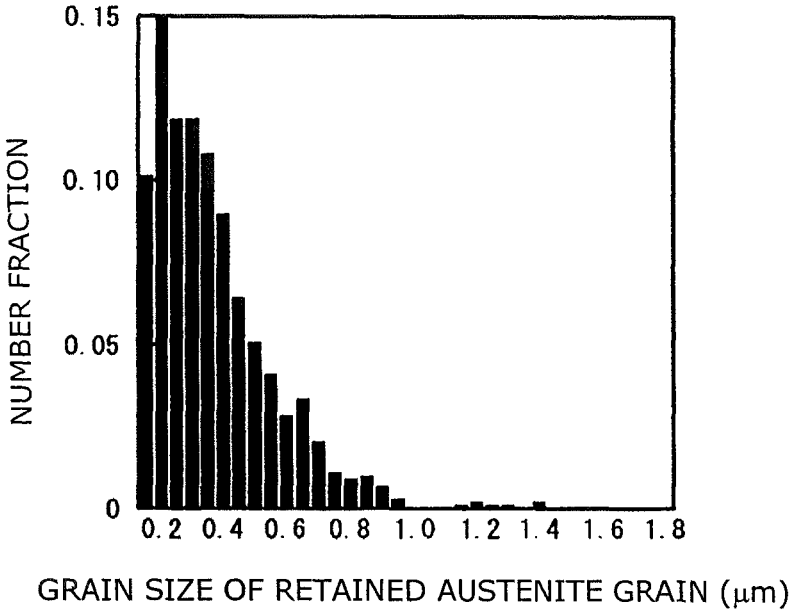
FIG. 1 is a graph showing grain size distribution of retained austenite in an annealed steel sheet produced through an immediate rapid cooling process.
Figure 2:
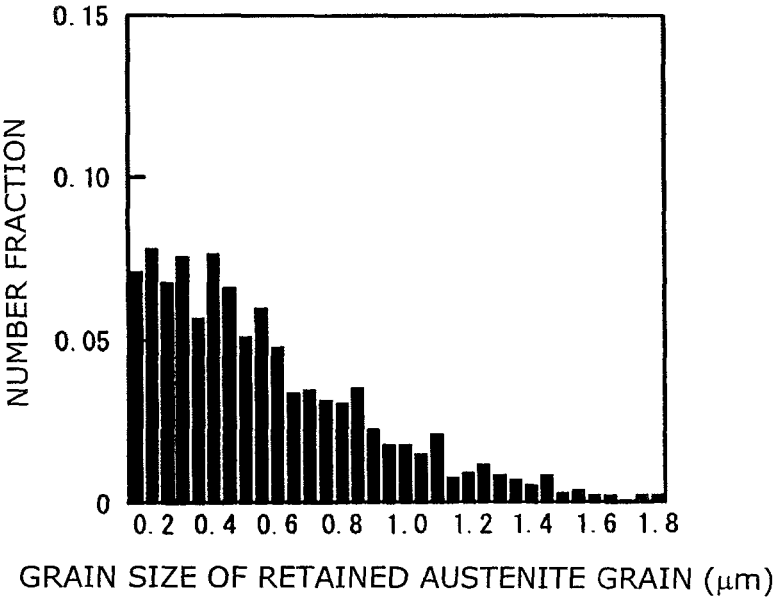
FIG. 2 is a graph showing grain size distribution of retained austenite in an annealed steel sheet produced without an immediate rapid cooling process.
Figure 3:
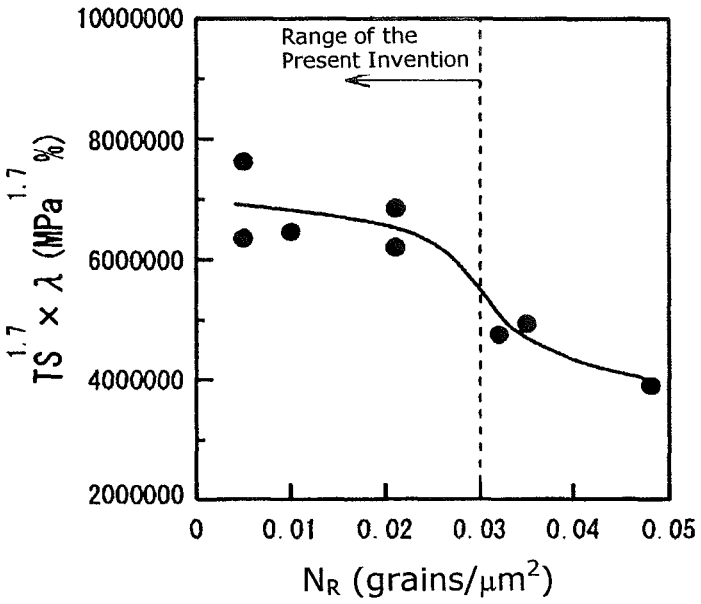
FIG. 3 is a graph showing a relation between $TS^{1.7}\times\lambda$, and a number density ($N_R$) of retained austenite whose grain size is 1.2 μm or more.
Figure 4:
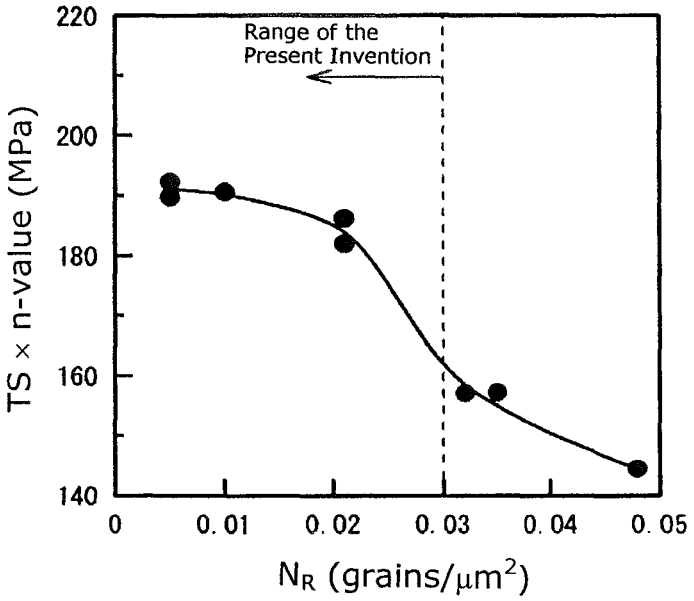
FIG. 4 is a graph showing a relation between a TS×n-value and the number density ($N_R$) of the retained austenite whose grain size is 1.2 μm or more.

The metallurgical structure and chemical composition in a high-strength cold-rolled steel sheet in accordance with the present invention, and the rolling and annealing conditions and the like in the method of producing the steel sheet efficiently, steadily, and economically are described in detail below.

1. Metallurgical Structure

The cold-rolled steel sheet of the present invention includes metallurgical structure whose main phase is a low-temperature transformation product, and whose secondary phase contains retained austenite and preferably further contains polygonal ferrite, the retained austenite has a volume fraction of more than 4.0% to less than 25.0% relative to the overall structure, and an average grain size thereof is less than 0.80 μm, and of the retained austenite, the number density of retained austenite grains whose grain size is 1.2 μm or more is $3.0\times10^{-2}$ grains/$\mu m^2$ or less, and the average grain size of grains having the bcc structure and grains having the bct structure that are surrounded by grain boundaries whose misorientation angle is preferably 15° or more is 7.0 μm or less, and/or the volume fraction of the polygonal ferrite relative to the overall structure is more than 2.0% to less than 27.0%, and the average grain size thereof is less than 5.0 μm.

The main phase means a phase or structure in which the volume fraction is at the maximum, and the secondary phase means a phase or structure other than the main phase.

The low-temperature transformation product means a phase and structure formed by low-temperature transformation, such as martensite and bainite. As a low-temperature transformation product other than these, bainitic ferrite and tempered martensite are cited. The bainitic ferrite is distinguished from polygonal ferrite in that a lath shape or a plate shape is taken and that the dislocation density is high, and is distinguished from bainite in that iron carbides do not exist inside and at the interface of grains.

This low-temperature transformation product may contain two or more kinds of phases and structures, for example, martensite and bainitic ferrite. In the case where the low-temperature transformation product contains two or more kinds of phases and structures, the sum of volume fractions of these phases and structures is defined as the volume fraction of the low-temperature transformation product.

The bcc phase is a phase having a body-centered cubic lattice (bcc lattice) type crystal structure, and this phase may be exemplified by polygonal ferrite, bainitic ferrite, bainite, and tempered martensite. Meanwhile, the bct phase is a phase having a body-centered tetragonal lattice (bct lattice) type crystal structure, and this phase may be exemplified by martensite. Grains having the bcc structure are a region surrounded by boundaries whose misorientation angle is 15° or more in the bcc phase. Similarly, grains having the bct structure are a region surrounded by boundaries whose misorientation angle is 15° or more in the bct phase. Hereinafter, the bcc phase and the bet phase are also collectively referred to as the bcc phase. This is because no lattice constant is taken into account in the metallurgical structure evaluation using an EBSP, and thus the bcc phase and the bct phase are detected without being distinguished from each other.

The reason for configuring the structure to include the low-temperature transformation product as its main phase and retained austenite in its secondary phase is because this configuration is preferable to enhance ductility, work hardenability, and stretch flangeability while maintaining tensile strength. If using polygonal ferrite, which is not the low-temperature transformation product, as main phase, it becomes difficult to secure the tensile strength as well as the stretch flangeability.

The volume fraction of the retained austenite relative to the overall structure is defined to be more than 4.0% to less than 25.0%. If the volume fraction of the retained austenite relative to the overall structure is 4.0% or less, the ductility becomes insufficient. Hence, the volume fraction of the retained austenite relative to the overall structure is defined to be more than 4.0%. Preferably, this ratio is more than 6.0%, more preferably more than 9.0%, and further more preferably more than 12.0%. On the other hand, if the volume fraction of the retained austenite relative to the overall structure is 25.0% or more, deterioration of the stretch flangeability becomes significant. Accordingly, the volume fraction of the retained austenite relative to the overall structure is defined to be less than 25.0%. Preferably, this ratio is less than 18.0%, more preferably less than 16.0%, and further more preferably less than 14.0%.

The average grain size of the retained austenite is defined to be less than 0.80 μm. In the cold-rolled steel sheet including the metallurgical structure whose main phase is the low-temperature transformation product, and whose secondary phase contains the retained austenite, if the average grain size of the retained austenite is 0.80 μm or more, deterioration of the ductility, the work hardenability, and the stretch flangeability becomes significant. Preferably, the average grain size of the retained austenite is less than 0.70 μm, and more preferably less than 0.60 μm. The lower limit of the average grain size of the retained austenite is not limited to specific one, but it is necessary to set the final rolling reduction in the hot rolling to be extremely high in order to refine the retained austenite to be 0.15 μm or less, which results in significant increase in production load. Accordingly, it is preferable to define the lower limit of the average grain size of the retained austenite to be more than 0.15 μm.

In the cold-rolled steel sheet including the metallurgical structure whose main phase is the low-temperature transformation product, and whose secondary phase contains the retained austenite, if the retained austenite whose average grain size is even less than 0.80 μm contains more coarse retained austenite grains whose grain size is 1.2 μm or more, the work hardenability and the stretch flangeability are rather deteriorated. Accordingly, the number density of the retained austenite grains whose grain size is 1.2 μm or more is defined to be $3.0\times10^{-2}$ grains/$\mu m^2$ or less. Preferably, the retained austenite grains whose grain size is 1.2 μm or more has a number density of $2.0\times10^{-2}$ grains/$\mu m^2$ or less, more preferably $1.5\times10^{-2}$ grains/$\mu m^2$ or less, and most preferably $1.0\times10^{-2}$ grains/$\mu m^2$ or less.

To further improve the ductility and work hardenability, the secondary phase preferably contains polygonal ferrite in addition to retained austenite. The volume fraction of polygonal ferrite relative to the overall structure preferably exceeds 2.0%. This volume fraction further preferably exceeds 8.0%, still further preferably exceeds 13.0%. On the other hand, if the volume fraction of polygonal ferrite is excessive, the stretch flangeability deteriorates. Therefore, the volume fraction of polygonal ferrite is preferably lower than 27.0%, further preferably lower than 24.0%, and still further preferably lower than 18.0%.

As the grains of polygonal ferrite are finer, the effect of improving the ductility and work hardenability increases. Therefore, the average grain size of polygonal ferrite is preferably made smaller than 5.0 μm. This average grain size is further preferably smaller than 4.0 μm, still further preferably smaller than 3.0 μm.

To further improve the stretch flangeability, the volume fraction of tempered martensite contained in the low-temperature transformation product relative to the overall structure is preferably made lower than 50.0%. This volume fraction is further preferably lower than 35.0%, still further preferably lower than 10.0%.

To enhance the tensile strength, the low-temperature transformation product preferably contains martensite. In this case, the volume fraction of martensite relative to overall structure preferably exceeds 4.0%. This volume fraction further preferably exceeds 6.0%, still further preferably exceeds 10.0%. On the other hand, if the volume fraction of martensite is excessive, the stretch flangeability deteriorates. Therefore, the volume fraction of martensite relative to overall structure is preferably made lower than 15.0%.

In order to further enhance the ductility, the work hardenability, and the stretch flangeability, it is preferable that the average grain size of the bcc grains (as described above, bcc grains collectively denote grains having the bcc structure and the bct structure that are surrounded by grain boundaries whose misorientation angle is 15° or more) is 7.0 μm or less. More preferably, the average grain size of the bcc grains is 6.0 μm or less, and further more preferably 5.0 μm or less.

The metallurgical structure of the cold-rolled steel sheet in accordance with the present invention is measured as described below. The volume fractions of low-temperature transformation product and polygonal ferrite are determined. Specifically, a test specimen is sampled from the steel sheet, and the longitudinal cross sectional surface thereof parallel to the rolling direction is polished, and is etched with nital. Thereafter, the metallurgical structure is observed by using a SEM at a position deep by one-fourth of thickness from the surface of steel sheet. By image processing, the area fractions of low-temperature transformation product and polygonal ferrite are measured. Assuming that the area fraction is equal to the volume fraction, the volume fractions of low-temperature transformation product and polygonal ferrite are determined. The average grain size of polygonal ferrite is determined as described below. A circle equivalent diameter is determined by dividing the area occupied by the whole of polygonal ferrite in a visual field by the number of crystal grains of polygonal ferrite, and the circle equivalent diameter is defined as the average grain size.

The volume fraction of retained austenite is determined as described below. A test specimen is sampled from the steel sheet, and the rolled surface thereof is chemically polished to a position deep by one-fourth of thickness from the surface of steel sheet, and the X-ray diffraction intensity is measured by using an XRD apparatus.

The grain size of retained austenite grains and the average grain size of retained austenite are measured as described below. A test specimen is sampled from the steel sheet, and the longitudinal cross sectional surface thereof parallel to the rolling direction is electropolished. The metallurgical structure is observed at a position deep by one-fourth of thickness from the surface of steel sheet by using a SEM equipped with an EBSP analyzer. A region that is observed as a phase consisting of a face-centered cubic crystal structure (fcc phase) and is surrounded by the matrix phase is defined as one retained austenite grain. By image processing, the number density (number of grains per unit area) of retained austenite grains and the area fractions of individual retained austenite grains are measured. From the areas occupied by individual retained austenite grains in a visual field, the circle equivalent diameters of individual retained austenite grains are determined, and the mean-value thereof is defined as the average grain size of retained austenite.

In the structure observation using the EBSP, in the region of 50 μm or larger in the sheet thickness direction and 100 μm or larger in the rolling direction, electron beams are irradiated at a pitch of 0.1 μm to make judgment of phase. Also, among the measured data, the data in which the reliability index (Confidence Index) is 0.1 or more are used for grain size measurement as effective data. To prevent the grain size of retained austenite from being undervalued by measurement noise, only the retained austenite grains each having a circle equivalent diameter of 0.15 μm or larger is taken as effective grains, whereby the average grain size is calculated.

The average grain size of the bcc grains are measured as follows. Specifically, a test specimen is collected from steel sheets, a longitudinal cross sectional surface thereof parallel to the rolling direction of each test specimen is electropolished, and an observation is conducted on metallurgical structure thereof at a position of deep by one-fourth of the thickness from the surface of steel sheet using an SEM equipped with an EBSP. A region that is observed as a bcc phase, and is surrounded by boundaries whose misorientation angle is 15° or more is defined as a one bcc grain, and a value calculated in accordance with the definition of the following Formula (1) is defined as the average grain size of the bcc grains. In this formula, N denotes the number of crystal grains contained in the average grain size evaluation region, $A_i$ denotes an area of an i-th (i=1, 2, . . . , N) crystal grain, and d, denotes a circle equivalent diameter of the i-th crystal grain, respectively.

[Expression 1]

$$D = \frac{\sum_{i=1}^{N} A_i \times d_i}{\sum_{i=1}^{N} A_i} \quad (1)$$

In the present invention, grains having the bcc structure and grains having the bct structure are integrally treated. This is because no lattice constant is taken into account in the metallurgical structure evaluation using the EBSP, so that it becomes difficult to distinguish grains having the bcc structure (such as polygonal ferrite, bainitic ferrite, bainite, and tempered martensite) from grains having the bct structure (such as martensite).

In this structure observation using the EBSP, as similar to the above case, the phase is determined by irradiation with an electron beam with intervals of 0.1 μm in a region of 50 μm in the sheet thickness direction, and of 100 μm in the rolling direction. Among obtained measurement data, such data having a Confident Index of 0.1 or more are used as effective data for measurement of the grain size. In order to prevent underestimation of the grain size caused by measurement noises, in the evaluation of the bcc phase, which is different from the case of the aforementioned retained austenite grains, only the bcc grains whose grain size is 0.47 μm or more are used as effective grains in the above grain size calculation. In the case of mixed-grain structure in which refined grains and coarse grains are mixed, if the grain size is evaluated using a intercept method that is generally used as a crystal grain size evaluation of metallurgical structure, influence caused by coarse grains may be underestimated. In the present invention, as a method of calculating the crystal grain size in consideration of influence caused by coarse grains, the above Formula (1) that multiplies an area of an individual crystal grain as a weight is used.

In the present invention, the aforementioned metallurgical structure is defined at a depth position of ¼ of the sheet thickness from a steel sheet surface in the case of using a cold-rolled steel sheet, and at a depth position of ¼ of the sheet thickness of a steel sheet that is base metal from a boundary between the steel sheet that is the base metal and a plated layer in the case of using a plated steel sheet.

In order to secure the impact energy absorbing property as a mechanical property that can be attained based on the characteristics of the aforementioned metallurgical structure, the cold-rolled steel sheet according to the present invention preferably has a tensile strength (TS) of 780 MPa or more in a direction vertical to the rolling direction, and more preferably has a tensile strength of 950 MPa or more. On the other hand, TS is preferably less than 1180 MPa in order to secure the ductility.

In the light of the press formability, it is preferable that El that is a value obtained by converting a total elongation ($El_0$) in a direction vertical to the rolling direction into a total stretch corresponding to that of a sheet thickness of 1.2 mm based on the following Formula (1); an n-value that is a work hardening coefficient calculated using nominal strains at two points of 5% and 10% where the strain range is defined to be 5 to 10%, and respective test forces corresponding to these strains in compliance with Japanese Industrial Standard JIS Z2253; and λ that is a limiting hole expansion ratio measured in compliance with the Japan Iron and Steel Federation standard JFST1001 satisfy the following conditions:

- a value of TS×El is 19000 MPa % or more, particularly 20000 MPa or more,
- a value of TS×n-value is 160 MPa or more, particularly 165 MPa or more, and
- a value of $TS^{1.7}\times\lambda$ is 5500000 $MPa^{1.7}$% or more, particularly 6000000 $MPa^{1.7}$% or more.

$$El = El_0 \times (1.2/t_0)^{0.2} \quad (2)$$

where $El_0$ in this formula denotes an actual measurement value of the total elongation that is measured using each JIS No. 5 tensile test specimen, $t_0$ denotes a sheet thickness of each JIS No. 5 tensile test specimen that is used for the measurement, and El denotes a converted value of the total elongation corresponding to that of a sheet thickness of 1.2 mm.

The work hardening coefficient is represented by an n-value corresponding to the strain range of 5 to 10% in the tensile test because a strain generated at the time of press-forming automotive parts is approximately 5 to 10%. If the steel sheet has a high total elongation, but has a small n-value, propagation property of the strain becomes insufficient during the press forming of automotive parts, which is likely to cause forming defects such as local reduction of the sheet thickness, etc. Preferably, the yield ratio is less than 80%, more preferably less than 75%, and further more preferably less than 70% in the light of shape fixability.

2. Chemical Composition of Steel

C: More than 0.020% to Less than 0.30%

The C content of 0.020% or less makes it difficult to attain the aforementioned metallurgical structure. Accordingly, the C content is defined to be more than 0.020%. Preferably, the C content is more than 0.070%, more preferably more than 0.10%, and further more preferably more than 0.14%. On the other hand, the C content of 0.30% or more deteriorates not only the stretch flangeability but also the weldability of the steel sheet. Accordingly, the C content is defined to be less than 0.30%. Preferably, the C content is less than 0.25%, more preferably less than 0.20%, and further more preferably less than 0.17%.

Si: More than 0.10% to 3.00% or Less

Si acts to improve the ductility, the work hardenability, and the stretch flange property through suppression of austenite grain growth during the annealing. Si is an element acting to enhance stability of austenite, and effective to attain the aforementioned metallurgical structure. The Si content of 0.10% or less makes it difficult to attain effects caused by the above actions. Accordingly, the Si content is defined to be more than 0.10%. Preferably, the Si content is more than 0.60%, more preferably more than 0.90%, and further more preferably more than 1.20%. On the other hand, the Si content of more than 3.00% deteriorates surface quality of the steel sheet. In addition, the chemical convertibility and the plating property become significantly deteriorated. Accordingly, the Si content is defined to be 3.00% or less. Preferably, the Si content is less than 2.00%, more preferably less than 1.80%, and further more preferably less than 1.60%.

In the case of containing Al described later, the Si content and the sol.Al content preferably satisfy Formula (3) below, more preferably satisfy Formula (4) below, and further more preferably satisfy Formula (5) below.

$$Si+sol.Al>0.60 \quad (3)$$

$$Si+sol.Al>0.90 \quad (4)$$

$$Si+sol.Al>1.20 \quad (5)$$

where in the formulas, Si represents the Si content, and sol.Al represents the acid-soluble Al content in mass percent in the steel.

Mn: More than 1.00% to 3.50% or Less

Mn is an element that acts to enhance hardenability of the steel, and effective to attain the aforementioned metallurgical structure. The Mn content of 1.00% or less makes it difficult to attain the aforementioned metallurgical structure. Accordingly, the Mn content is defined to be more than 1.00%. Preferably, the Mn content is more than 1.50%, more preferably more than 1.80%, and further more preferably more than 2.10%. An excessive Mn content causes a coarse low-temperature transformation product expanding in the rolling direction in the metallurgical structure of the hot-rolled steel sheet, and increases coarse retained austenite grains in the metallurgical structure after the cold rolling and the annealing, resulting in deterioration of the work hardenability and the stretch flangeability. Accordingly, the Mn content is defined to be 3.50% or less. Preferably, the Mn content is less than 3.00%, more preferably less than 2.80%, and further more preferably less than 2.60%.

P: 0.10% or Less

P is an element contained as an impurity in the steel, and segregates to grain boundaries, and embrittles the steel. Hence, it is preferable to define the P content to be as small as possible. Accordingly, the P content is defined to be 0.10% or less. Preferably, the P content is less than 0.050%, more preferably less than 0.020%, further more preferably less than 0.015%.

S: 0.010% or Less

S is an element contained as an impurity in the steel, and generates sulfide inclusions, and deteriorates the stretch flangeability. Hence, it is preferable to define the S content to be as small as possible. Accordingly, the S content is defined to be 0.010% or less. Preferably, the S content is less than 0.005%, more preferably less than 0.003%, and further more preferably less than 0.002%.

Sol.Al: 2.00% or Less

Al acts to deoxidize molten steel. The present invention contains Si having a deoxidization effect, which is the same as Al, and thus Al is not always necessary to be contained. In other words, the Al content may be as close to 0% as possible. In the case of containing Al for the sake of encouraging deoxidization, Al may preferably be contained as sol.Al whose content is 0.0050% or more. More preferably, the sol.Al content is more than 0.020%. Moreover, Al is an element acting to enhance stability of austenite as similar to Si, and effective to attain the aforementioned metallurgical structure, so that Al may be contained for this purpose. In this case, the sol.Al content is preferably more than 0.040%, more preferably more than 0.050%, and further more preferably more than 0.060%.

On the other hand, if the sol.Al content is excessively high, not only surface defects resulting from alumina are likely to be caused, but also the transformation temperature becomes greatly increased, which makes it difficult to attain the metallurgical structure whose main phase is the low-temperature transformation product. Accordingly, the sol.Al content is defined to be 2.00% or less. Preferably, the sol.Al content is less than 0.60%, more preferably less than 0.20%, and further more preferably less than 0.10%.

N: 0.010% or Less

N is an element contained as an impurity in the steel, and deteriorates the ductility. Hence, it is preferable to define the N content to be as small as possible. Accordingly, the N content is defined to be 0.010% or less. Preferably, the N content is 0.006% or less, and more preferably 0.005% or less.

The steel sheet according to the present invention may contain the following elements as optional elements.

One or More Types Selected from a Group of Ti: Less than 0.050%, Nb: Less than 0.050%, and V: 0.50% or Less.

Ti, Nb, and V act to suppress recrystallization in the hot rolling process, thereby to increase work strain, and refine the metallurgical structure of the hot-rolled steel sheet. They precipitate as carbide or nitride, and act to restrain coarsening of austenite during the annealing. Accordingly, one or more types of these elements may be contained. Excessive contents of these elements, however, rather saturate effects caused by the above actions, which is uneconomical. Adding to this, the excessive contents thereof increase recrystallization temperature during the annealing, which makes the metallurgical structure after the annealing ununiform, and deteriorates the stretch flangeability. Furthermore, the amount of precipitation of carbide or nitride becomes increased, the yield ratio becomes increased, and shape fixability becomes deteriorated, as well.

Accordingly, the Ti content is defined to be less than 0.050%, the Nb content is defined to be less than 0.050%, and the V content is defined to be 0.50% or less. Preferably, the Ti content is less than 0.040%, and more preferably less than 0.030%; preferably, the Nb content is less than 0.040%, and more preferably less than 0.030%; and preferably, the V content is 0.30% or less, and more preferably less than 0.050%. In order to more securely attain effects caused by the above actions, it is preferable to satisfy any one of Ti: 0.005% or more, Nb: 0.005% or more, and V: 0.010% or more. In the case of containing Ti, it is more preferable to define the Ti content to be 0.010% or more; in the case of containing Nb, it is more preferable to define the Nb content to be 0.010% or more; and in the case of containing V, it is more preferable to define the V content to be 0.020% or more.

One or More Types Selected from a Group of Cr: 1.0% or Less, Mo: 0.50% or Less, and B: 0.010% or Less.

Cr, Mo, and B are elements acting to enhance quenching property of the steel, and effective to attain the aforementioned metallurgical structure. Accordingly, one or more types of these elements may be contained. Excessive contents of these elements, however, rather saturate effect caused by the above action, which is uneconomical. Accordingly, the Cr content is defined to be 1.0% or less; the Mo content is defined to be 0.50% or less; and the B content is defined to be 0.010% or less. The Cr content is preferably 0.50% or less; the Mo content is preferably 0.20% or less;

and the B content is preferably 0.0030% or less. In order to more securely attain the effect caused by the above action, it is preferable to satisfy any one of Cr: 0.20% or more, Mo: 0.05% or more, and B: 0.0010% or more.

One or More Types Selected from a Group of Ca: 0.010% or Less, Mg: 0.010% or Less, REM: 0.050% or Less, and Bi: 0.050% or Less.

Ca, Mg, REM, and Bi all act to improve the stretch flangeability, by adjusting shapes of inclusions in the cases of Ca, Mg, and REM, and by refining solidification structure in the case of Bi. Accordingly, one or more types of these elements may be contained. Excessive contents thereof, however, rather saturate effect caused by the above action, which is uneconomical.

Accordingly, the Ca content is defined to be 0.010% or less; the Mg content is defined to be 0.010% or less; the REM content is defined to be 0.050% or less; and the Bi content is defined to be 0.050% or less. The Ca content is preferably 0.0020% or less; the Mg content is preferably 0.0020% or less; the REM content is preferably 0.0020% or less; and the Bi content is preferably 0.010% or less. In order to more securely attain the above action, it is preferable to satisfy any one of Ca: 0.0005% or more, Mg: 0.0005% or more, and REM: 0.0005% or more, and Bi: 0.0010% or more. REM denotes rare earth element, and is a general term for 17 elements in total of Sc, Y, and lanthanoid, and the REM content is a total content of these elements.

3. Production Condition

The steel having the aforementioned chemical composition is melted with a well-known method, and thereafter is produced into an ingot through a continuous casting process, or alternatively is produced into an ingot through any casting process, and thereafter is produced into a billet through a bloming or the like. In the continuous casting process, in order to suppress generation of surface defects resulting from inclusions, it is preferable to generate molten steel agitation using electromagnetic stirring or the like in the molten steel in the mold. The ingot or billet that is once cooled may be reheated to be hot-rolled; or the ingot in a high-temperature state after the continuous casting, or the billet in a high-temperature state after the billeting may be hot-rolled as it is, or alternatively may be held at a high temperature or heated through assist heating to be hot-rolled. In the present specification, such an ingot and a billet are collectively referred to as "slabs" as starting material for use in the hot rolling. The temperature of the slab for use in the hot rolling is preferably less than 1250° C. for the sake of preventing coarsening of austenite, and more preferably 1200° C. or less. The lower limit of the slab for use in the hot rolling is not limited to a specific one, and any temperature may be used as far as the hot rolling can be completed at the $Ar_3$ point or more, as described later.

The hot rolling is completed in a temperature range at the $Ar_3$ point or more so as to transform austenite after completion of the hot rolling, thereby to refine the metallurgical structure of the hot-rolled steel sheet. If the finish rolling temperature is excessively low, a coarse low-temperature transformation product expanding in the rolling direction is generated, which increases coarse retained austenite grains in the metallurgical structure after the cold rolling and the annealing, and thus the work hardenability and the stretch flangeability are likely to become deteriorated. Hence, the finish rolling temperature is preferably the $Ar_3$ point or higher and higher than 820° C. More preferably, this temperature is the $Ar_3$ point or higher and higher than 850° C., and further more preferably the $Ar_3$ point or higher and higher than 880° C. On the other hand, if the finish rolling temperature is excessively high, accumulation of work strain becomes insufficient, and thus it becomes difficult to refine the metallurgical structure of the hot-rolled steel sheet. Accordingly, the finish rolling temperature is preferably lower than 950° C., and more preferably lower than 920° C. For the sake of reducing production load, it is preferable to increase the finish rolling temperature, thereby to reduce rolling load. From this point of view, the finish rolling temperature is preferably the $Ar_3$ point or higher and higher than 780° C., and more preferably the $Ar_3$ point or higher and higher than 800° C.

In the case of the hot rolling including rough rolling and finish rolling, in order to complete the finish rolling at the temperatures above, roughly rolled material may be heated between the rough rolling and the finish rolling. At this time, it is preferable to heat the roughly rolled material such that a rear end thereof has a higher temperature than a temperature of a front end thereof, thereby to reduce variation in temperature in the overall length of the roughly rolled material at the start of the finish rolling to be 140° C. or less. This configuration enhances uniformity of the product property in the coil.

The heating method of the roughly rolled material may be carried out using a well-known means. For example, a solenoid-type induction heating device may be disposed between a rough rolling mill and a finish rolling mill, thereby to control increase in heating temperature based on the temperature distribution in the longitudinal direction of the roughly rolled material upstream of this solenoid-type induction heating device, or the like.

Rolling reduction of the hot rolling is defined such that the rolling reduction of the final one pass becomes more than 25% in terms of the reduction rate of the sheet thickness. This is for the purpose of increasing work strain introduced in austenite, refining the metallurgical structure of the hot-rolled steel sheet, suppressing generation of coarse retained austenite grains in the metallurgical structure after the cold rolling and the annealing, and also refining bcc grains. In the case of the secondary phase containing polygonal ferrite, this is for the purpose of refining the polygonal ferrite. Preferably, the rolling reduction in the final one pass is more than 30%, and more preferably more than 40%. Excessively high rolling reduction increases the rolling load, which makes it difficult to carry out the rolling. Accordingly, the rolling reduction in the final one pass is preferably defined to be less than 55%, and more preferably less than 50%. For the sake of reducing the rolling load, so-called lubrication rolling may be carried out in such a manner that rolling oil is supplied between rolling rolls and the steel sheet so as to lower the coefficient of friction in the rolling.

After the hot rolling, the steel sheet is rapidly cooled down to a temperature range of 720° C. or lower within 0.40 seconds after the completion of the rolling. This is for the purpose of reducing release of the work strain introduced in austenite through the rolling, transforming the austenite using the work strain as a driving force, refining the metallurgical structure of the hot-rolled steel sheet, and reducing generation of coarse retained austenite grains in the metallurgical structure after the cold rolling and the annealing as well as refining bcc grains. In the case of the secondary phase containing polygonal ferrite, this is for the purpose of refining the polygonal ferrite. Preferably, the steel sheet is rapidly cooled down to a temperature range of 720° C. or lower within 0.30 seconds after completion of the rolling, and more preferably, rapidly cooled down to a temperature range of 720° C. or lower within 0.20 seconds after completion of the rolling. Since release of the work strain is reduced as the average cooling rate during the rapid cooling becomes more increased, it is preferable to define the average cooling rate during the rapid cooling to be 300° C./s or more, thereby to further refine the metallurgical structure of the hot-rolled steel sheet. More preferably, the average cooling rate during the rapid cooling is 400° C./s or more, and further more preferably 600° C./s or more. It is unnecessary to specifically define a time period from the completion of the rolling until start of the rapid cooling as well as the cooling rate during this time period.

Equipment for carrying out the rapid cooling is not limited to a specific one, and industrially, it is preferable to use water spray equipment having a high water quantity density; and such a method may be exemplified that disposes a water spray header between rolled-sheet transfer rollers so as to inject high-pressure water with sufficient water quantity density upwardly and downwardly onto the rolled sheet.

After the rapid cooling is stopped, the steel sheet is coiled in a temperature range of higher than 500° C. This is because iron carbide does not sufficiently precipitate in the hot-rolled steel sheet if the coiling temperature is 500° C. or lower, and consequently coarse retained austenite grains are generated as well as bcc grains become coarse in the metallurgical structure after the cold rolling and the annealing. Preferably, the coiling temperature is more than 550° C., and more preferably more than 580° C. On the other hand, an excessively high coiling temperature coarsens ferrite in the hot-rolled steel sheet, so that coarse retained austenite grains are generated in the metallurgical structure after the cold rolling and the annealing. Accordingly, the coiling temperature is preferably lower than 650° C., and more preferably lower than 620° C.

Conditions from the stop of the rapid cooling until the coiling are not limited to specific ones, and it is preferable to hold the steel sheet in a temperature range of 720 to 600° C. for one second or more after the rapid cooling is stopped. This configuration encourages generation of refined ferrite. To the contrary, excessively longer holding time deteriorates productivity, and thus it is preferable to define the upper limit of the holding time in the temperature range of 720 to 600° C. to be within 10 seconds. After the steel sheet is held in the temperature range of 720 to 600° C., it is preferable to cool the steel sheet down to the coiling temperature at the cooling rate of 20° C./s or more for the sake of preventing coarsening of the generated ferrite.

The hot-rolled steel sheet is subjected to descaling with pickling, or the like, and thereafter is cold-rolled in accordance with a conventional method. In the cold rolling, in order to encourage recrystallization and uniform the metallurgical structure after the cold rolling and the annealing, thereby to further enhance the stretch flangeability, it is preferable to define the cold rolling reduction (total draft in the cold rolling) to be 40% or more. Excessively high cold rolling reduction increases the rolling load, which makes it difficult to carry out the rolling, and thus it is preferable to define the upper limit of the cold rolling reduction to be less than 70%, and more preferable to be less than 60%.

The steel sheet after the cold rolling is subjected to treatment such as degreasing in accordance with a conventional method if necessary, and thereafter the steel sheet is subjected to the annealing. The lower limit of a soaking temperature in the annealing is defined to be ($Ac_3$ point−40° C.) or higher. This is for the purpose of attaining the metallurgical structure whose main phase is the low-temperature transformation product, and whose secondary phase contains the retained austenite. In order to increase the volume fraction of the low-temperature transformation product, and to enhance the stretch flangeability, it is preferable to define the soaking temperature to be higher than ($Ac_3$ point−20° C.), and more preferable to be higher than the $Ac_3$ point. An excessively high soaking temperature excessively coarsens austenite, so that the metallurgical structure after the annealing becomes coarse, generation of polygonal ferrite is reduced, which results in deterioration of the ductility, the work hardenability, and the stretch flangeability. Accordingly, it is preferable to define the upper limit of the soaking temperature to be lower than ($Ac_3$ point+100° C.), and more preferable to be lower than ($Ac_3$ point+50° C.), and further more preferable to be lower than ($Ac_3$ point+20° C.). Defining the upper limit of the soaking temperature to be lower than ($Ac_3$ point+50° C.) makes it possible to refine bcc grains to the average grain size of 7.0 μm or less, thereby to attain particularly excellent ductility, work hardenability, and stretch flangeability.

The holding time at the soaking temperature (the soaking time) need not be subject to any special restriction; however, to attain stable mechanical properties, the holding time is preferably made longer than 15 seconds, further preferably made longer than 60 seconds. On the other hand, if the holding time is too long, austenite is coarsened excessively, so that the ductility, work hardenability, and stretch flangeability are liable to deteriorate. Therefore, the holding time is preferably made shorter than 150 seconds, further preferably made shorter than 120 seconds.

In the heating process in annealing, to homogenize the metal structure after annealing by means of the promotion of crystallization and to further improve the stretch flangeability, the heating rate from 700° C. to the soaking temperature is preferably made lower than 10.0° C./s. It is further preferably made lower than 8.0° C./s, still further preferably made lower than 5.0° C./s.

In the cooling process after the soaking in the annealing, in order to encourage generation of refined polygonal ferrite, and to enhance the ductility and the work hardenability, it is preferable to cool the steel sheet from the soaking temperature by 50° C. or more at a cooling rate of less than 5.0° C./s. The cooling rate at this time is more preferably less than 3.0° C./s, and further more preferably less than 2.0° C./s. In order to further increase the volume fraction of polygonal ferrite, the steel sheet is more preferably cooled by 80° C. or more, and further more preferably cooled by 100° C. or more, and most preferably cooled by 120° C. or more. After the soaking at less than ($Ac_3$ point+50° C.), by cooling the steel sheet at a cooling rate of less than 5.0° C./s from the soaking temperature by 50° C. or more, it is possible to generate polygonal ferrite whose average grain size is less than 5.0 μm by more than 2.0% in terms of the volume fraction relative to the overall structure, thereby to attain particularly excellent ductility, work hardenability, and stretch flangeability.

In order to attain the metallurgical structure whose main phase is the low-temperature transformation product, it is preferable to cool the steel sheet in a temperature range of 650 to 500° C. at a cooling rate of 15° C./s or more. It is more preferable to cool the steel sheet in a temperature range of 650 to 450° C. at a cooling rate of 15° C./s or more. As the cooling rate becomes more increased, the volume fraction of the low-temperature transformation product becomes more increased, and thus in any of the above temperature ranges, it is more preferable to define the cooling rate to be more than 30° C./s, and further more preferable to be more than 50° C./s. On the other hand, an excessively high cooling rate rather deteriorates the shape of the steel sheet, and thus it is preferable to define the cooling rate to be 200° C./s or less in a temperature range of 650 to 500° C. The cooling rate is more preferably less than 150° C./s, and further more preferably less than 130° C./s.

In order to secure an amount of the retained austenite, the steel sheet is held for 30 seconds or more in a temperature range of 450 to 340° C. in the cooling process. In order to enhance stability of the retained austenite, thereby to further enhance the ductility, the work hardenability, and the stretch flangeability, the holding temperature range is preferably 430 to 360° C. As the holding time is set to be longer, the stability of the retained austenite becomes more enhanced; therefore, the holding time is preferably defined to be 60 seconds or more. The holding time is more preferably 120 seconds or more, and further more preferably more than 300 seconds.

In the case where an electroplated steel sheet is produced, after the cold-rolled steel sheet produced by the above-described method has been subjected to well-known preparations as necessary to clean and condition the surface, electroplating has only to be performed pursuant to an ordinary method. The chemical composition and weight of plating film is not subject to any special restriction. As the kind of electroplating, electro galvanizing, Zn—Ni alloy electroplating, and the like are cited.

In the case where a hot dip plated steel sheet is produced, the steel sheet is treated in the above-described method up to the annealing process, and after being held in the temperature region of 450 to 340° C. for 30 seconds or longer, the steel sheet is heated as necessary, and is immersed in a plating bath for hot dip plating. In order to enhance the stability of retained austenite and to further improve the ductility, work hardenability, and stretch flangeability, the holding temperature region is preferably made 430 to 360° C. Also, as the holding time is made longer, the stability of retained austenite increases. Therefore, the holding time is preferably made 60 seconds or longer, further preferably made 120 seconds or longer, and still further preferably made 300 seconds or longer. The steel sheet may be reheated after being hot dip plated for alloying treatment. The chemical composition and weight of deposit of plating film is not subject to any special restriction. As the kind of hot dip plating, galvanizing, galvanizing, hot dip aluminum plating, hot dip Zn—Al alloy plating, hot dip Zn—Al—Mg alloy plating, hot dip Zn—Al—Mg—Si alloy plating, and the like are cited.

The plated steel sheet may be subjected to suitable chemical conversion treatment after being plated to further enhance the corrosion resistance. In place of the conventional chromate treatment, the chemical conversion treatment is preferably performed by using a chromium-free type chemical conversion liquid (for example, silicate-based or phosphate-based).

The cold-rolled steel sheet and plated steel sheet thus obtained may be subjected to skin-pass rolling pursuant to an ordinary method. However, a large elongation percentage of skin-pass rolling leads to the deterioration in ductility. Therefore, the elongation percentage of skin-pass rolling is preferably made 1.0% or smaller, further preferably made 0.5% or smaller The present invention will be exemplified by using the following Example. The present invention is not limited to the Example.

Example 1

Using an experimental vacuum melting furnace, steels having the chemical compositions shown in Table 1 were melted and casted. Each obtained ingot was produced into a billet having a thickness of 30 mm through hot forging. Each billet was heated to 1200° C. using an electric heating furnace, and was held at this temperature for 60 minutes, and thereafter was hot-rolled under the conditions shown in Table 2.

Specifically, by using an experimental hot-rolling mill, 6-pass rolling was performed in the temperature region of $Ar_3$ point or higher to finish each of the billets into a steel sheet having a thickness of 2 to 3 mm. The draft of the final one pass was set at 12 to 42% in terms of the reduction rate of the sheet thickness. After hot rolling, the steel sheet was cooled to a temperature of 650 to 720° C. under various cooling conditions by using a water spray. After having been cooled naturally for 5 to 10 seconds, the steel sheet was cooled to various temperatures at a cooling rate of 60° C./s, and these temperatures were taken as coiling temperatures. The steel sheet was charged into an electric heating furnace that was held at that temperature, and was held for 30 minutes. Thereafter, the gradual cooling after coiling was simulated by furnace-cooling the steel sheet to room temperature at a cooling rate of 20° C./h, whereby a hot-rolled steel sheet was obtained.

Each produced hot-rolled steel sheet was subjected to acid pickling so as to be base metal for cold rolling, and was subjected to cold rolling with cold rolling reduction of 50 to 60%, thereby to produce a cold-rolled steel sheet having a thickness of 1.0 to 1.2 mm. Using a continuous annealing simulator, each produced cold-rolled steel sheet was heated up to 550° C. at a heating rate of 10° C./s, and thereafter, was heated up to each temperature shown in Table 2 at a heating rate of 2° C./s, and was then soaked for 95 seconds. Thereafter, each cold-rolled steel sheet was subjected to primary cooling down to each temperature shown in Table 2, was further subjected to secondary cooling from the stop temperature of the primary cooling down to each stop temperature of the cooling shown in Table 2 at an average cooling rate of 60° C./s, and was held at this temperature for 330 seconds, and thereafter was cooled down to a room temperature, thereby to attain an annealed steel sheet.

TABLE 1

| | Chemical composition (mass %) (remainder: Fe and impurities) | | | | | | | | $Ac_3$ point | $Ar_3$ point |
|---|---|---|---|---|---|---|---|---|---|---|
| Steel | C | Si | Mn | P | S | sol.Al | N | Others | (° C.) | (° C.) |
| A | 0.124 | 0.05* | 2.97 | 0.011 | 0.003 | 0.031 | 0.0041 | | 792 | 698 |
| B | 0.145 | 0.99 | 2.49 | 0.012 | 0.004 | 0.029 | 0.0048 | | 836 | 742 |
| C | 0.147 | 0.98 | 2.48 | 0.011 | 0.003 | 0.030 | 0.0038 | Nb: 0.011 | 840 | 753 |
| D | 0.145 | 1.25 | 2.49 | 0.010 | 0.001 | 0.049 | 0.0030 | | 846 | 742 |
| E | 0.149 | 1.49 | 2.48 | 0.010 | 0.001 | 0.050 | 0.0035 | | 862 | 752 |
| F | 0.146 | 1.25 | 2.48 | 0.009 | 0.001 | 0.150 | 0.0032 | Nb: 0.010 | 874 | 764 |
| G | 0.166 | 1.51 | 2.53 | 0.010 | 0.001 | 0.048 | 0.0032 | Nb: 0.011 | 856 | 741 |

TABLE 1-continued

| Steel | Chemical composition (mass %) (remainder: Fe and impurities) C | Si | Mn | P | S | sol.Al | N | Others | $Ac_3$ point (° C.) | $Ar_3$ point (° C.) |
|---|---|---|---|---|---|---|---|---|---|---|
| H | 0.174 | 1.26 | 2.50 | 0.008 | 0.001 | 0.050 | 0.0032 | Nb: 0.013 | 839 | 742 |
| I | 0.176 | 1.26 | 2.51 | 0.008 | 0.001 | 0.051 | 0.0031 | Nb: 0.011 | 843 | 736 |
| J | 0.175 | 1.25 | 2.50 | 0.008 | 0.001 | 0.050 | 0.0033 | Ti: 0.021 | 848 | 750 |
| K | 0.175 | 1.30 | 2.53 | 0.008 | 0.001 | 0.045 | 0.0030 | Nb: 0.010 | 849 | 731 |
| L | 0.184 | 1.28 | 2.24 | 0.009 | 0.001 | 0.050 | 0.0032 | Nb: 0.011 | 854 | 754 |
| M | 0.203 | 1.28 | 1.93 | 0.009 | 0.001 | 0.051 | 0.0027 | Nb: 0.011 | 855 | 768 |
| N | 0.197 | 1.26 | 1.92 | 0.009 | 0.001 | 0.140 | 0.0033 | Nb: 0.010 | 870 | 781 |
| O | 0.198 | 1.26 | 2.22 | 0.009 | 0.001 | 0.143 | 0.0031 | Nb: 0.011 | 855 | 758 |
| P | 0.197 | 1.28 | 2.24 | 0.009 | 0.001 | 0.151 | 0.0029 | Nb: 0.011 Cr: 0.30 | 848 | 786 |
| Q | 0.150 | 1.51 | 2.51 | 0.008 | 0.001 | 0.052 | 0.0034 | V: 0.11 REM: 0.0006 | 872 | 783 |
| R | 0.151 | 1.50 | 2.52 | 0.009 | 0.001 | 0.047 | 0.0031 | Bi: 0.008 | 862 | 772 |
| S | 0.149 | 1.25 | 2.47 | 0.009 | 0.001 | 0.152 | 0.0033 | Ca: 0.0009 Mg: 0.0007 | 864 | 775 |
| T | 0.148 | 1.26 | 2.48 | 0.009 | 0.001 | 0.141 | 0.0030 | Mo: 0.10 B: 0.0015 | 877 | 741 |

Note)
1. $Ac_3$ point was determined from thermal expansion change at the time when cold-rolled steel sheet was heated at 2° C./s.
2. $Ar_3$ point was determined from thermal expansion change at the time when cold-rolled steel sheet was heated to 900° C. and thereafter was cooled at 0.01° C./s.

TABLE 2

| Test No. | Steel | Hot Rolling Condition: Final Pass Rolling Reduction (%) | Sheet Thickness After Rolling[1] (mm) | Finish Rolling Temp. (° C.) | Stop Temp, of Rapid Cooling (° C.) | Time Until Rapid Cooling Stop[2] (s) | Average Cooling Rate[3] (° C./s) | Coiling Temp.[4] (° C.) | Annealing Condition: Soaking Temp. (° C.) | Primary Cooling Rate (° C./s) | Stop Temp, of Primary Cooling (° C.) | Stop Temp, of Secondary Cooling (° C.) |
|---|---|---|---|---|---|---|---|---|---|---|---|---|
| 1 | A* | 22 | 2.0 | 830 | 650 | 0.17 | 1200 | 600 | 850 | 1.7 | 700 | 400 |
| 2 | B | 25 | 3.0 | 830 | 680 | 4.14 | 61 | 600 | 820 | 2.0 | 700 | 350 |
| 3 | B | 25 | 3.0 | 840 | 710 | 0.20 | 722 | 600 | 790 | 2.0 | 700 | 350 |
| 4 | C | 25 | 3.0 | 830 | 670 | 4.14 | 65 | 600 | 820 | 2.0 | 700 | 350 |
| 5 | C | 25 | 3.0 | 850 | 690 | 0.20 | 889 | RT | 820 | 2.0 | 700 | 350 |
| 6 | D | 42 | 2.0 | 900 | 660 | 0.18 | 1500 | 520 | 850 | 1.7 | 700 | 375 |
| 7 | E | 33 | 2.0 | 900 | 660 | 0.17 | 1600 | 600 | 850 | 1.7 | 700 | 350 |
| 8 | E | 42 | 2.0 | 900 | 660 | 0.18 | 1500 | 560 | S50 | 1.7 | 700 | 350 |
| 9 | F | 33 | 2.0 | 900 | 660 | 0 17 | 1600 | 520 | 850 | 1.7 | 700 | 375 |
| 10 | G | 33 | 2.0 | 900 | 650 | 0.17 | 1667 | 540 | 865 | 1.8 | 700 | 350 |
| 11 | H | 22 | 2.0 | 900 | 720 | 5.52 | 51 | 600 | 850 | 1.7 | 700 | 350 |
| 12 | I | 42 | 2.0 | 900 | 660 | 0.18 | 1500 | 560 | 850 | 1.7 | 700 | 425 |
| 13 | I | 33 | 2.0 | 900 | 660 | 0.17 | 1600 | RT | 850 | 1.7 | 700 | 375 |
| 14 | I | 33 | 2.0 | 900 | 660 | 0.17 | 1600 | 600 | 900 | 2.2 | 700 | 425 |
| 15 | J | 42 | 2.0 | 900 | 660 | 0.18 | 1500 | 560 | 850 | 1.7 | 700 | 400 |
| 16 | J | 33 | 2.0 | 900 | 660 | 0.17 | 1600 | 600 | 900 | 2.2 | 700 | 400 |
| 17 | K | 12 | 2.0 | 900 | 660 | 0.15 | 1846 | 560 | 850 | 1.7 | 700 | 375 |
| 18 | K | 33 | 2.0 | 900 | 660 | 0.17 | 1600 | 600 | 790 | 1.0 | 700 | 400 |
| 19 | K | 42 | 2.0 | 900 | 660 | 0.17 | 1600 | 560 | 910 | 6.0 | 790 | 425 |
| 20 | K | 42 | 2.0 | 900 | 660 | 0.17 | 1600 | 560 | 850 | 0.4 | 810 | 425 |
| 21 | L | 33 | 2.0 | 900 | 660 | 0.17 | 1600 | 600 | 850 | 1.7 | 700 | 400 |
| 22 | L | 42 | 2.0 | 900 | 660 | 0.18 | 1500 | 560 | 850 | 1.7 | 700 | 400 |
| 23 | M | 33 | 2.0 | 900 | 670 | 0.17 | 1533 | 600 | 850 | 1.7 | 700 | 350 |
| 24 | M | 42 | 2.0 | 900 | 660 | 0.18 | 1500 | 560 | 850 | 1 7 | 700 | 400 |
| 25 | N | 33 | 2.0 | 900 | 660 | 0.18 | 1500 | 510 | 850 | 1.7 | 700 | 400 |
| 26 | O | 33 | 2.0 | 900 | 670 | 0.17 | 1533 | 520 | 850 | 1.7 | 700 | 400 |
| 27 | P | 33 | 2.0 | 900 | 660 | 0.18 | 1500 | 510 | 850 | 1.7 | 700 | 350 |
| 28 | Q | 42 | 2.0 | 900 | 650 | 0.18 | 1563 | 560 | 865 | 1.8 | 700 | 350 |
| 29 | R | 42 | 2.0 | 900 | 650 | 0.18 | 1563 | 560 | 865 | 1.8 | 700 | 350 |
| 30 | S | 42 | 2.0 | 900 | 660 | 0.18 | 1500 | 560 | 865 | 1.8 | 700 | 400 |
| 31 | T | 42 | 2.0 | 900 | 660 | 0.18 | 1500 | 560 | 865 | 1.8 | 700 | 400 |

[1] Sheet thickness of hot-rolled steel sheet.
[2] Time period from rolling completion until rapid cooling stop.
[3] Average cooling rate during rapid cooling.
[4] RT denotes room temperature.

A test specimen for SEM observation was sampled from the annealed steel sheet, and the longitudinal cross sectional surface thereof parallel to the rolling direction was polished. Thereafter, it was etched with nital and the metallurgical structure was observed at a position deep by one-fourth of thickness from the surface of steel sheet, and by image processing, the volume fractions of low-temperature transformation product and polygonal ferrite were measured. Also, the average grain size (circle equivalent diameter) of polygonal ferrite was determined by dividing the area occupied by the whole of polygonal ferrite by the number of crystal grains of polygonal ferrite.

Also, a test specimen for XRD measurement was sampled from the annealed steel sheet, and the rolled surface was chemically polished down to a position deep by one-fourth of thickness from the surface of steel sheet. Thereafter, an X-ray diffraction test was conducted to measure the volume fraction of retained austenite. Specifically, RINT2500 manufactured by Rigaku Corporation was used as an X-ray diffractometer, and Co-Kα beams were applied to measure the integrated intensities of α phase (110), (200), (211) diffraction peaks and γ phase (111), (200), (220) diffraction peaks, whereby the volume fraction of retained austenite was determined.

Furthermore, a test specimen for EBSP measurement was sampled from the annealed steel sheet, and the longitudinal cross sectional surface thereof parallel to the rolling direction was electropolished. Thereafter, the metallurgical structure was observed at a position deep by one-fourth of thickness from the surface of steel sheet, and by image analysis, the average grain size of bcc grains, the grain size distribution of retained austenite and the average grain size of retained austenite were measured. Specifically, as an EBSP measuring device, OIM5 manufactured by TSL Solutions K.K. was used, electron beams were irradiated at a pitch of 0.1 μm in a region having a size of 50 μm in the sheet thickness direction and 100 μm in the rolling direction, and among the obtained data, the data in which the Confidence Index was 0.1 or more was used as effective data to make judgment of bcc phase and fcc phase.

Each region observed as a bcc phase, and surrounded by grain boundaries whose misorientation angle was 15° or more was treated as a one bcc grain, and a circle equivalent diameter and an area of each bcc grain were determined so as to calculate an average grain size in accordance with the definition of the aforementioned Formula (1). In this average grain size calculation, bcc grains whose circle equivalent diameter was 0.47 μm or more were treated as effective bcc grains. Although, strictly speaking, a crystal structure of martensite is a body-centered tetragonal lattice (bct), no lattice constant is taken into account in the metallurgical structure evaluation using an EBSP, so that martensite was also treated as the bcc phase.

With a region that was observed as the fcc phase and was surrounded by a matrix phase being made one retained austenite grain, the circle equivalent diameter of individual retained austenite grain was determined. The average grain size of retained austenite was calculated as the mean-value of circle equivalent diameters of individual effective retained austenite grains, the effective retained austenite grains being retained austenite grains each having a circle equivalent diameter of 0.15 μm or larger. Also, the number density ($N_R$) per unit area of retained austenite grains each having a grain size of 1.2 μm or larger was determined.

The yield stress (YS) and tensile strength (TS) were determined by sampling a JIS No. 5 tensile test specimen along the direction perpendicular to the rolling direction from the annealed steel sheet, and by conducting a tensile test at a testing speed of 10 mm/min. The total elongation (El) was determined as follows: a tensile test was conducted by using a JIS No. 5 tensile test specimen sampled along the direction perpendicular to the rolling direction, and by using the obtained actually measured value ($El_0$), the converted value of total elongation corresponding to the case where the sheet thickness is 1.2 mm was determined based on formula (2) above. The work hardening coefficient (n-value) was determined with the strain range being 5 to 10% by conducting a tensile test by using a JIS No. 5 tensile test specimen sampled along the direction perpendicular to the rolling direction. Specifically, the n-value was calculated by the two point method by using test forces with respect to nominal strains of 5% and 10%.

The stretch flangeability was evaluated by measuring the limiting hole expansion ratio (λ) by the method described below. From the annealed steel sheet, a 100-mm square hole expanding test specimen was sampled. A 10-mm diameter punched hole was formed with a clearance being 12.5%, the punched hole was expanded from the sagging side by using a cone-shaped punch having a top angle of 60°, and the expansion ratio of the hole at the time when a crack penetrating the sheet thickness was generated was measured. This expansion ratio was used as the limiting hole expansion ratio.

Table 3 gives the metallurgical structure observation results and the performance evaluation results of the cold-rolled steel sheet after being annealed. In Tables 1 to 3, mark "*" attached to a symbol or numeral indicates that the symbol or numeral is out of the range of the present invention.

TABLE 3

| | | | Metallic Structure of Cold-rolled Steel Sheet | | | | | | | | | | | | | | | |
|---|---|---|---|---|---|---|---|---|---|---|---|---|---|---|---|---|---|---|
| | | Cold-rolled Steel | Volume FractionRatio (%) | | | Average Grain Size(μm) | | | | Mechanical Properties of Cold-rolled Steel Sheet[2)] | | | | | | | |
| Test No. | Steel | Sheet Thickness (mm) | Low-temp Transformation Product | Retained Austenite | Polygonal Ferrite | Polygonal Ferrite | bcc Grains | Retained Austenite | $N_R$[1)] (grains/μm$^2$) | YS (MPa) | TS (MPa) | El (%) | n-value | λ (%) | TS × El (MPa %) | TS × n-value (MPa) | $TS^{1.7} \times \lambda$ ($MPa^{1.7}$%) |
| 1 | A* | 1.0 | 78 | 4.0* | 18 | 6.4 | 8.5 | 0.81* | 0.005 | 502 | 716 | 24.8 | 0.175 | 47 | 17757 | 125 | 3353127 |
| 2 | B | 1.2 | 64 | 10 | 26 | 6.8 | 8.0 | 0.82* | 0.037* | 503 | 978 | 17.1 | 0.148 | 35 | 16724 | 145 | 4242717 |
| 3 | B | 1.2 | 39* | 8 | 53 | 4.8 | 5.6 | 0.83* | 0.039* | 520 | 1056 | 15.5 | 0.159 | 32 | 16368 | 168 | 4419556 |
| 4 | C | 1.2 | 64 | 8 | 28 | 7.3 | 7.5 | 0.71 | 0.036* | 511 | 1020 | 16.0 | 0.143 | 33 | 16320 | 146 | 4296692 |
| 5 | C | 1.2 | 65 | 10 | 25 | 5.9 | 7.4 | 0.72 | 0.036* | 586 | 1042 | 13.8 | 0.141 | 33 | 14380 | 147 | 4455424 |
| 6 | D | 1.0 | 86 | 7 | 7 | 1.4 | 4.3 | 0.42 | 0.006 | 521 | 952 | 22.1 | 0.202 | 83 | 21039 | 192 | 9610830 |
| 7 | E | 1.0 | 80 | 8 | 12 | 2.5 | 4.1 | 0.44 | 0.007 | 512 | 963 | 22.3 | 0.200 | 57 | 21475 | 193 | 6730379 |
| 8 | E | 1.0 | 78 | 8 | 14 | 3.2 | 4.2 | 0.43 | 0.006 | 519 | 964 | 22.1 | 0.189 | 74 | 21304 | 182 | 8753116 |
| 9 | F | 1.0 | 73 | 10 | 17 | 3.2 | 5.6 | 0.55 | 0.018 | 606 | 1003 | 21.5 | 0.167 | 57 | 21565 | 168 | 7212510 |
| 10 | G | 1.0 | 83 | 8 | 9 | 1.6 | 4.8 | 0.52 | 0.015 | 633 | 1095 | 18.9 | 0.161 | 66 | 20696 | 176 | 9695003 |
| 11 | H | 1.0 | 90 | 8 | 2.0 | 0.6 | 7.6 | 0.74 | 0.036* | 760 | 1084 | 17.3 | 0.136 | 29 | 18753 | 147 | 4187432 |
| 12 | I | 1.0 | 80 | 15 | 5 | 0.8 | 5.1 | 0.50 | 0.014 | 685 | 1034 | 23.4 | 0.186 | 48 | 24196 | 192 | 6396261 |
| 13 | I | 1.0 | 89 | 9 | 2.0 | 1.0 | 7.5 | 0.73 | 0.036* | 738 | 1051 | 18.0 | 0.141 | 30 | 18918 | 148 | 4110038 |

TABLE 3-continued

| | | | Metallic Structure of Cold-rolled Steel Sheet | | | | | | | | | | | | | | | |
|---|---|---|---|---|---|---|---|---|---|---|---|---|---|---|---|---|---|---|
| | | Cold-rolled Steel Sheet Thickness (mm) | Volume FractionRatio (%) | | | Average Grain Size(μm) | | | | Mechanical Properties of Cold-rolled Steel Sheet[2)] | | | | | | | |
| Test No. | Steel | | Low-temp Transformation Product | Retained Austenite | Polygonal Ferrite | Polygonal Ferrite | bcc Grains | Retained Austenite | $N_R$[1)] (grains/μm$^2$) | YS (MPa) | TS (MPa) | El (%) | n-value | λ (%) | TS × El (MPa %) | TS × n-value (MPa) | $TS^{1.7}$ × λ ($MPa^{1.7}$%) |
| 14 | I | 1.0 | 85 | 13 | 2.0 | 0.8 | 7.1 | 0.62 | 0.027 | 696 | 1039 | 18.7 | 0.157 | 57 | 19429 | 163 | 7658104 |
| 15 | J | 1.0 | 80 | 14 | 6 | 1.0 | 5.3 | 0.51 | 0.013 | 670 | 1023 | 22.9 | 0.190 | 49 | 23427 | 194 | 6411869 |
| 16 | J | 1.0 | 85 | 13 | 2.0 | 1.1 | 7.2 | 0.64 | 0.028 | 715 | 1045 | 18.4 | 0.154 | 58 | 19228 | 161 | 7869111 |
| 17 | K | 1.0 | 90 | 8 | 2.0 | 0.9 | 7.5 | 0.71 | 0.036* | 736 | 1040 | 18.2 | 0.143 | 30 | 18928 | 149 | 4037178 |
| 18 | K | 1.0 | 42* | 13 | 45 | 4.9 | 5.8 | 0.82* | 0.040* | 642 | 990 | 20.5 | 0.196 | 27 | 20295 | 194 | 3341516 |
| 19 | K | 1.0 | 88 | 12 | 0.0 | — | 7.2 | 0.62 | 0.028 | 792 | 1099 | 17.3 | 0.147 | 62 | 19013 | 162 | 9164057 |
| 20 | K | 1.0 | 87 | 13 | 0.0 | — | 5.4 | 0.58 | 0.026 | 799 | 1065 | 18.1 | 0.153 | 67 | 19277 | 163 | 9387915 |
| 21 | L | 1.0 | 78 | 12 | 10 | 2.2 | 4.9 | 0.51 | 0.013 | 501 | 930 | 23.5 | 0.243 | 55 | 21855 | 226 | 6120455 |
| 22 | L | 1.0 | 77 | 13 | 10 | 2.0 | 5.0 | 0.51 | 0.014 | 457 | 937 | 22.3 | 0.243 | 54 | 20895 | 228 | 6086268 |
| 23 | M | 1.0 | 65 | 10 | 25 | 4.7 | 5.1 | 0.54 | 0.018 | 569 | 985 | 22.6 | 0.172 | 52 | 22261 | 169 | 6380356 |
| 24 | M | 1.0 | 61 | 13 | 26 | 4.8 | 6.3 | 0.62 | 0.025 | 575 | 901 | 26.4 | 0.184 | 59 | 23786 | 166 | 6221343 |
| 25 | N | 1.0 | 61 | 14 | 25 | 4.5 | 6.2 | 0.65 | 0.028 | 527 | 879 | 27.1 | 0.193 | 64 | 23821 | 170 | 6470846 |
| 26 | O | 1.0 | 74 | 12 | 14 | 2.3 | 5.2 | 0.55 | 0.021 | 693 | 993 | 22.2 | 0.169 | 53 | 22045 | 168 | 6593099 |
| 27 | P | 1.0 | 85 | 11 | 4 | 0.7 | 4.6 | 0.43 | 0.008 | 571 | 1071 | 19.3 | 0.187 | 49 | 20670 | 200 | 6931675 |
| 28 | Q | 1.0 | 77 | 8 | 15 | 2.9 | 4.1 | 0.42 | 0.006 | 587 | 1011 | 21.5 | 0.192 | 77 | 21737 | 194 | 9875695 |
| 29 | R | 1.0 | 77 | 9 | 14 | 2.8 | 4.1 | 0.41 | 0.007 | 535 | 986 | 21.6 | 0.199 | 72 | 21298 | 196 | 8849592 |
| 30 | S | 1.0 | 84 | 9 | 7 | 1.4 | 4.2 | 0.43 | 0.007 | 699 | 1061 | 20.3 | 0.177 | 86 | 21538 | 188 | 11973320 |
| 31 | T | 1.0 | 73 | 10 | 17 | 2.5 | 4.3 | 0.47 | 0.010 | 534 | 999 | 22.8 | 0.212 | 75 | 22777 | 212 | 9425895 |

[1)] $N_R$: Number density of retained austenite grains whose grain size is 1.2 μm or more;
[2)] El: Converted total stretch corresponding to sheet thickness of 1.2 mm,
λ: Limiting Hole expandion ratio,
n-value: Work hardening coefficent;

Each steel sheet within the range defined by the present invention had the following test results: the TS×El value was 19000 MPa % or more, the value of TS×n-value was 160 or more, and the $TS^{1.7}$×λ, value was 6000000 $MPa^{1.7}$% or more, which exhibited preferable ductility, work hardenability, and stretch flangeability. In particular, in such a steel sheet that had an average grain size of bcc grains of 7.0 μm or less, and/or had its secondary phase containing retained austenite as well as polygonal ferrite whose volume fraction was more than 2.0% to less than 27.0%, and whose average grain size was less than 5.0 μm, the TS×El value was 20000 MPa % or more, the value of the TS×n-value was 165 or more, and the $TS^{1.7}$×λ value was 6000000 $MPa^{1.7}$% or more, which exhibited further enhanced ductility, work hardenability, and stretch flangeability.

The invention claimed is:

1. A cold-rolled steel sheet having a chemical composition consisting of, in mass percent, C: more than 0.020% to less than 0.30%; Si: more than 0.10% to at most 3.00%; Mn: more than 1.00% to at most 3.50%; P: at most 0.10%; S: at most 0.010%; sol.Al: at least 0% and at most 2.00%; N: at most 0.010%; Ti: at least 0% and less than 0.050%; Nb: at least 0% and less than 0.050%; V: at least 0% and at most 0.50%; Cr: at least 0% and at most 1.0%; Mo: at least 0% and at most 0.50%; B: at least 0% and at most 0.010%; Ca: at least 0% and at most 0.010%; Mg: at least 0% and at most 0.010%; REM: at least 0% and at most 0.050%; Bi: at least 0% and at most 0.050%; and the remainder being Fe and impurities, and having metallurgical structure whose main phase is a low-temperature transformation product, and whose secondary phase contains retained austenite, the retained austenite having a volume fraction of more than 4.0% to less than 25.0% relative to overall structure, and an average grain size of less than 0.80 μm, and wherein of the retained austenite, a number density of retained austenite grains whose grain size is 1.2 μm or more is $3.0\times10^{-2}$ grains/μm$^2$ or less.

2. The cold-rolled steel sheet as set forth in claim 1, wherein the average grain size of the grains having a bcc structure and the grains having a bct structure surrounded by a grain boundary having a misorientation angle of 15 or larger is 7.0 μm or smaller in the metallurgical structure.

3. The old-rolled steel sheet as set forth in claim 1, wherein in the metallurgical structure, the secondary phase contains the retained austenite and polygonal ferrite, and the polygonal ferrite has a volume fraction relative to overall structure of more than 2.0% to less than 27.0%, and an average grain size of less than 5.0 μm.

4. The cold-rolled steel sheet as set forth in claim 1, wherein the chemical composition contains, in mass percent, one kind or two or more kinds selected from a group consisting of Ti: at least 0.005% and less than 0.050%, Nb: at least 0.005% and less than 0.050%, and V: at least 0.010% and at most 0.50%.

5. The cold-rolled steel sheet as set forth in claim 1, wherein the chemical composition contains, in mass percent, one kind or two or more kinds selected from a group consisting of Cr: at least 0.20% and at most 1.0%, Mo: at least 0.05% and at most 0.50%, and B: at least 0.0010% and at most 0.010%.

6. The old-rolled steel sheet as set forth in claim 1, wherein the chemical composition contains, in mass percent, one kind or two or more kinds selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.50%.

* * * * *